US008157192B2

(12) United States Patent
Claas

(10) Patent No.: US 8,157,192 B2
(45) Date of Patent: Apr. 17, 2012

(54) FLUID ACTIVATED NOZZLE

(76) Inventor: James Claas, Watertown, WI (US)

( * ) Notice: Subject to any disclaimer, the term of this patent is extended or adjusted under 35 U.S.C. 154(b) by 337 days.

(21) Appl. No.: 12/387,532

(22) Filed: May 4, 2009

(65) Prior Publication Data

US 2009/0289126 A1 Nov. 26, 2009

Related U.S. Application Data

(60) Provisional application No. 61/128,263, filed on May 20, 2008.

(51) Int. Cl.
*B05B 15/08* (2006.01)

(52) U.S. Cl. ..... 239/588; 239/17

(58) Field of Classification Search ..... 239/588, 239/323, 328, 356, 362, 363, 17, 20; 222/321.6, 222/321.7, 321.9
See application file for complete search history.

(56) References Cited

U.S. PATENT DOCUMENTS

| | | | | |
|---|---|---|---|---|
| 3,092,329 A | | 6/1963 | Twaroch | |
| 3,369,758 A | | 2/1968 | Hruby, Jr. | |
| 3,698,637 A | * | 10/1972 | McCullough | 239/68 |
| 3,874,595 A | | 4/1975 | Rindisbacher | |
| 4,073,438 A | | 2/1978 | Meyer | |
| 4,817,688 A | * | 4/1989 | Corniea | 141/140 |
| 5,108,035 A | | 4/1992 | Friedrichs | |
| 5,186,394 A | | 2/1993 | Tsuji | |
| 6,053,423 A | | 4/2000 | Jacobsen | |
| 6,131,819 A | | 10/2000 | Fuller et al. | |
| 6,148,453 A | | 11/2000 | Sartor | |
| 2002/0039537 A1 | * | 4/2002 | Taniguchi | 417/478 |

FOREIGN PATENT DOCUMENTS

| | | |
|---|---|---|
| DE | 3-138545 | 7/1982 |
| JP | 3-118857 | 5/1991 |
| JP | 4-219158 | 8/1992 |
| JP | 4-219159 | 8/1992 |
| JP | 4-219167 | 8/1992 |
| JP | 8-010668 | 1/1996 |

* cited by examiner

*Primary Examiner* — Davis Hwu
(74) *Attorney, Agent, or Firm* — Donald J. Ersler

(57) ABSTRACT

A nozzle assembly for use in spraying a fluid. The nozzle assembly includes a nozzle portion, a base portion, and a plurality of elastic bellows disposed between the nozzle portion and the base portion. The bellows are coupled to both the nozzle portion and the base portion. Movement of the nozzle is achieved by activation of the bellows.

16 Claims, 8 Drawing Sheets

FLUID ACTIVATED NOZZLE

RELATED APPLICATION

This application claims the benefit of U.S. Provisional Patent Application Ser. No. 61/128,263, filed 20 May 2008 and entitled "FLUID ACTIVATED NOZZLE."

BACKGROUND OF THE INVENTION

Movable nozzles are utilized in many different types of applications including fountains and cleaning devices. Such nozzle may be utilized to spray any type of fluid. In a fountain application, the nozzle is typically located in a body of water such as a pool fountain, pond or lake. The nozzle may be movable to create a pleasing visual effect such as a "dancing" fountain. Many such nozzles utilize mechanical linkages to change the direction of the nozzle.

In a cleaning application, a nozzle may either spray water, a cleaning solution, or air. The nozzle may be movable to maximize the surface area that is sprayed.

SUMMARY OF THE INVENTION

The present invention provides a system and method for a fluid actuated nozzle.

One aspect of the invention provides a nozzle system including a base portion, a nozzle portion flexible coupled to the base portion, at least one bellows between the nozzle portion and the base portion, and at least one pressure inlet in fluid communication with bellows. The base portion includes a fluid inlet, a fluid outlet in fluid communication with the fluid inlet and a bellows retaining portion. The nozzle portion includes a bellows retaining portion and a hollow nozzle. The nozzle includes a fluid inlet and a fluid outlet in fluid communication with the fluid inlet. The nozzle fluid inlet is in fluid communication with the base portion fluid outlet.

The at least one pressure inlet of the system may be an aperture through the bellows retaining portion The at least one pressure inlet may be coupled, directly or indirectly, to a bellows activation means.

The bellows activation means may be a pump having an inlet coupled, either directly or indirectly, to a fluid source and an outlet coupled, either directly or indirectly, to the at least one pressure inlet.

The base portion may be coupled to the nozzle portion through a flexible coupling.

The base portion may be integrally formed to nozzle portion.

The system may further include means for coupling the at least one bellows to the nozzle bellows retaining portion and the base bellows retaining portion.

The means for coupling may take the form of at least one projection formed on the nozzle bellows retaining portion, the at least one projection sized and configured to fit within an opening on the top of the bellows.

The means for coupling may take the form of at least one projection formed on the base bellows retaining portion, the at least on projection sized and configured to fit within an opening on the bottom of the bellows.

The system may further include a pump, the pump having an inlet coupled to a fluid source and an outlet coupled to the base portion fluid inlet.

Another aspect of the invention is a method including providing a nozzle system including a base portion, a nozzle portion flexibly coupled to the base portion, a plurality of elastic bellows disposed between the base portion and the nozzle portion, and a plurality of bellows pressure inlets in fluid communication with a pressure inlet. The base portion has a fluid inlet, a fluid outlet in fluid communication with the fluid inlet and a bellows retaining portion. The nozzle portion has a bellows retaining portion and a hollow nozzle. The nozzle has a fluid inlet and a fluid outlet in fluid communication with the fluid inlet. The nozzle fluid inlet is in fluid communication with the base portion fluid outlet. The method further includes providing a fluid to the base portion fluid inlet and activating at least one of the bellows.

The activating step may include providing a first fluid source, providing at least one pump, each at least one pump having an inlet coupled to the first fluid source and an outlet coupled to at least one of the bellows pressure inlets, and operating the at least one pump to provide fluid from the first fluid source to its associated bellows pressure inlet.

The operating step may include filling at least a portion of at least one of the bellows with fluid.

The method may include providing fluid to the nozzle.

The providing fluid step may include providing a second pump, the second pump having an inlet coupled to the first fluid source and an outlet coupled to the base portion fluid inlet and operating the second pump to provide fluid to the nozzle through the base portion fluid inlet.

The providing fluid step may include providing a second fluid source, providing a second pump, the second pump having an inlet coupled to the second fluid source and an outlet coupled to the base portion fluid inlet, and operating the second pump to provide fluid to the nozzle through the base portion fluid inlet.

The method may include the fluid exiting the nozzle through the nozzle output in a first direction.

The method may include the direction of the fluid exiting the nozzle outlet being changed by activation of at least one of the bellows.

Another aspect of the invention provides a method including providing a nozzle system, the nozzle system including a base portion, a nozzle portion flexibly coupled to the base portion, a plurality of elastic bellows disposed between the base portion and the nozzle portion and a plurality of pressure inlets, each of the plurality of bellows being aligned with a pressure inlet. The base portion has a fluid inlet, a fluid outlet in fluid communication with the fluid inlet and a bellows retaining portion. The nozzle portion has a bellows retaining portion and a hollow nozzle, the nozzle having a fluid inlet and a fluid outlet in fluid communication with the fluid inlet, the nozzle fluid inlet being in fluid communication with the base portion fluid outlet. The method further including a first pressure inlet in fluid communication with a first bellows and a second pressure inlet is in fluid communication with a second bellows. The method further including providing fluid to the base portion fluid inlet, activating a first bellows by providing fluid to the first bellows through the first pressure inlet, and activating a second bellows by providing fluid to the second bellows through the second pressure inlet.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
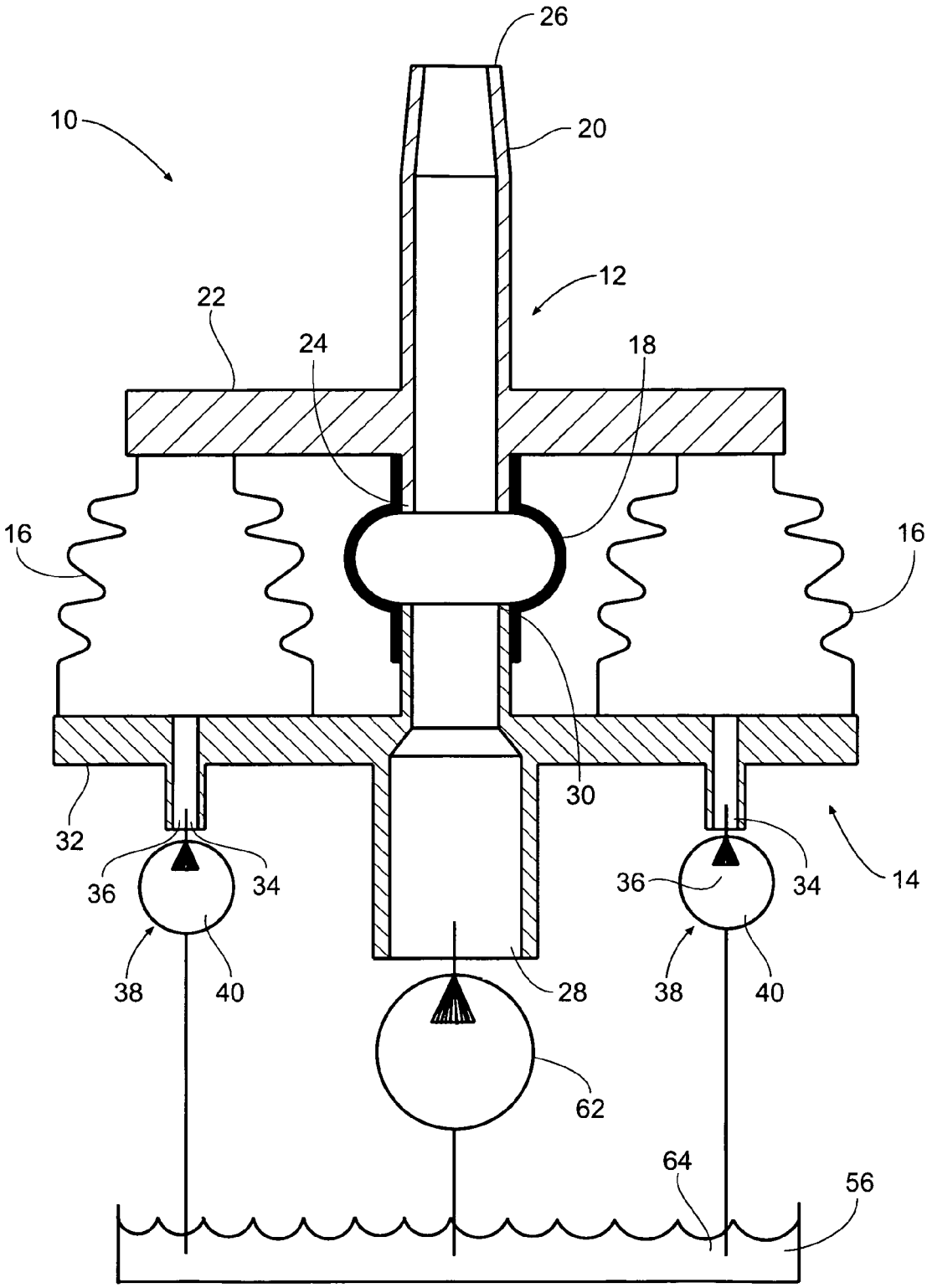
FIG. 1 is a cross sectional schematic of an embodiment of a nozzle assembly.

FIG. 1 shows a nozzle assembly 10 according to an embodiment of the present invention. The nozzle assembly 10 preferably includes a nozzle portion 12, a base portion 14, and a plurality of elastic bellows 16 disposed between the nozzle portion 12 and the base portion 14.

Figure 2:
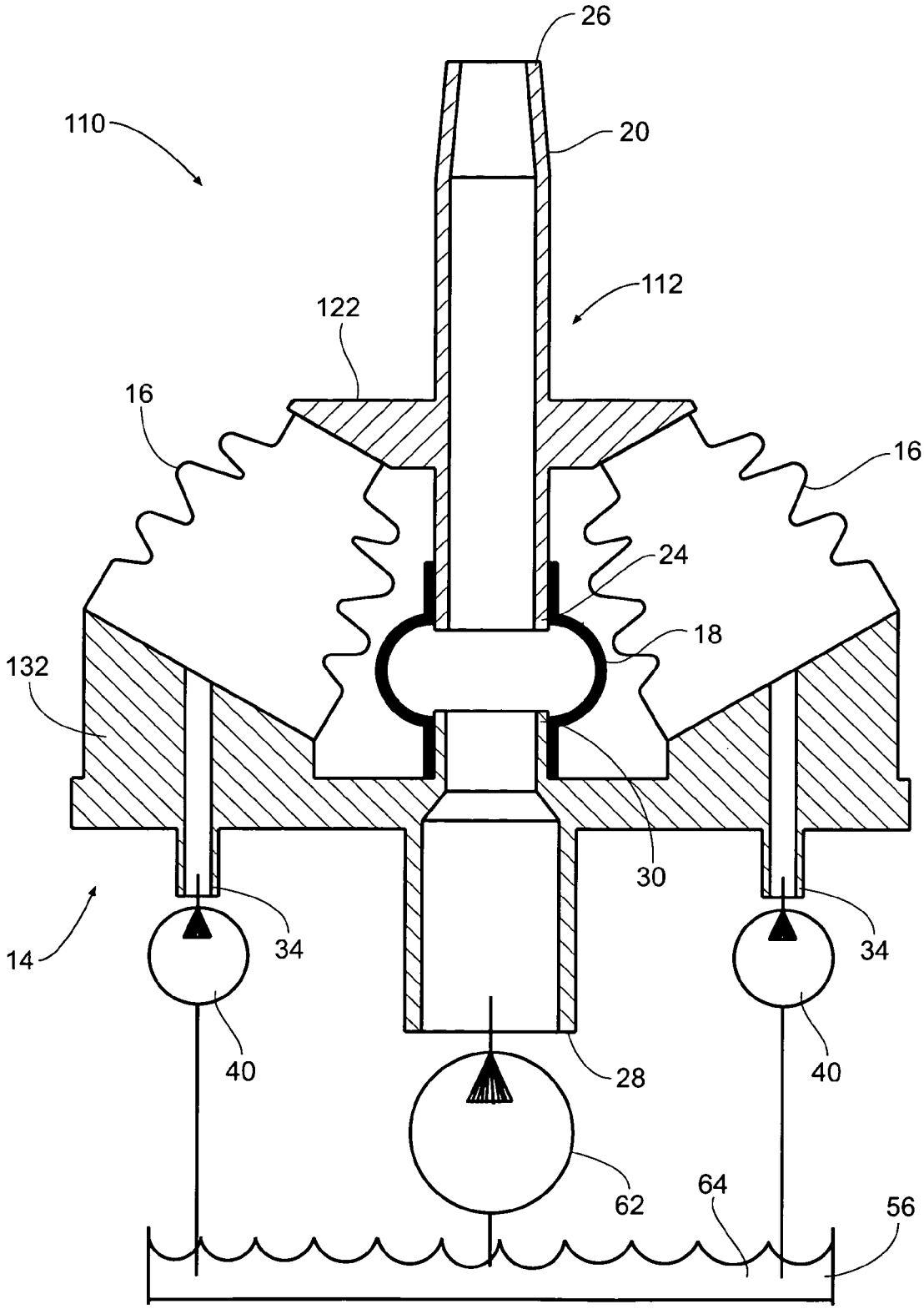
FIG. 2 is a cross sectional schematic of an alternative embodiment of a nozzle assembly
Figure 3:
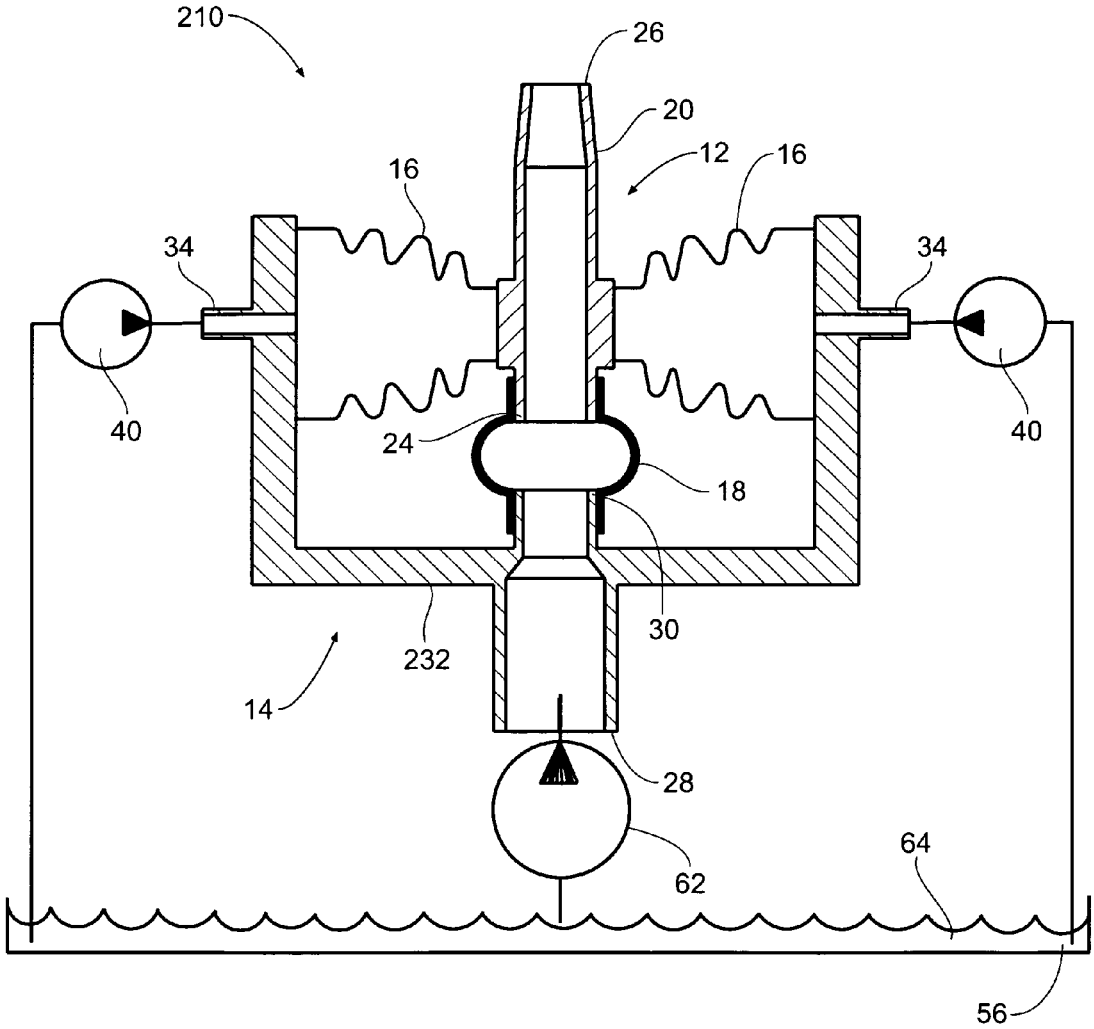
FIG. 3 is a cross sectional schematic of an alternative embodiment of a nozzle assembly
Figure 4:
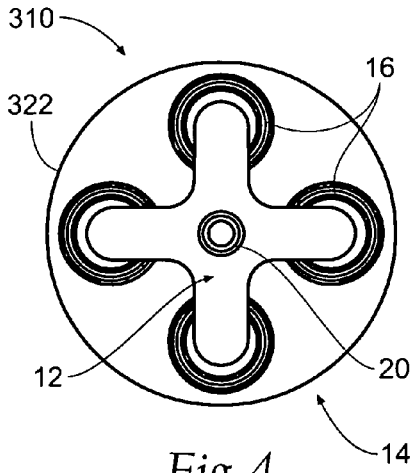
FIG. 4 is a top plan view of an alternative embodiment of a nozzle assembly.
Figure 5:
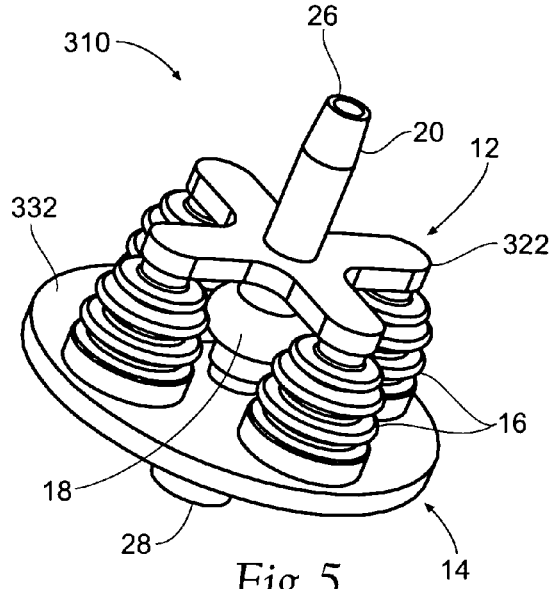
FIG. 5 is a perspective view of the nozzle assembly of FIG. 4.
Figure 6:
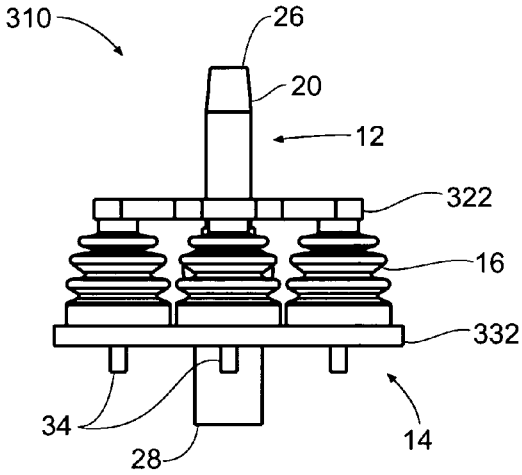
FIG. 6 is a side view of the nozzle assembly of FIG. 4.
Figure 7:
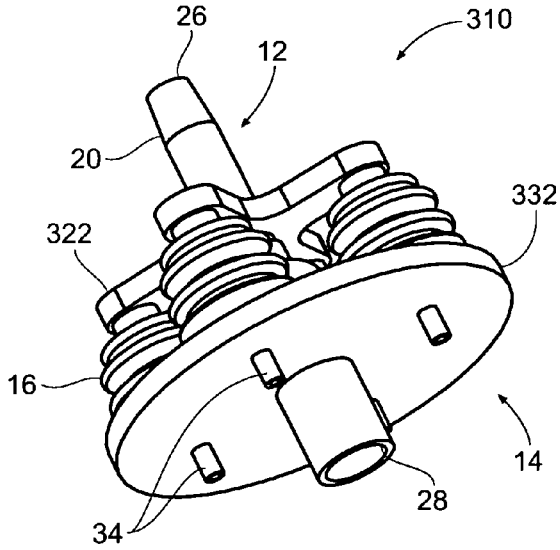
FIG. 7 is a perspective view of the nozzle assembly of FIG. 4.

The nozzle portion 12 is preferably in fluid communication with the base portion 14. The nozzle portion 12 and base portion 14 may be formed as two separate pieces coupled by a flexible coupling 18 as shown in FIGS. 1 to 3. It is also contemplated that the nozzle portion 12 and the base portion 14 could be formed as a single piece with a flexible transition portion.

The nozzle portion 12 preferably includes a nozzle 20. The nozzle 20 is preferably a generally hollow member with a first end 24 comprising a fluid inlet and a second end 26 comprising a fluid outlet. The nozzle portion 12 preferable includes a bellows retaining portion 22. The bellows retaining portion 22 is adapted to engage at least one bellows 16. The particular configuration of the bellows retaining portion 22, 122, 222, 322 may vary based on the configuration of the bellows 16 as shown in FIGS. 1 to 3. The bellows retaining portion 22 may be integrally formed to the nozzle 20, or may be formed separately and coupled by any means known in the art. In the illustrated embodiment the nozzle 20 may be pointed at the fluid outlet 26, however it is not necessary.

As shown in FIG. 1, the base portion 14 preferable includes fluid inlet 28, a fluid outlet 30, at least one bellows retaining portion 32 and at least one pressure inlet 34.

The bellows retaining portions 32 are sized and configured to engage the bellows 16. The particular configuration of the bellows retaining portion 32,132,232,332 may vary based on the configuration of the bellows 16 as shown in FIGS. 1 to 3. The bellows retaining portion 32 may be integrally formed to the base portion 14, or may be formed separately and coupled by any means known in the art. The pressure inlet(s) 34 are preferable sized and configured to correspond with the bellows 16 to activate the bellows 16. In the illustrated embodiment the pressure inlet 34 comprises an aperture 36 through the bellows retaining portion 32. The pressure inlets 34 are preferable adapted to be coupled, either directly or indirectly, to a bellows activation means 38. The bellows activation means 38 may take any form known in the art including, but not limited to a pump 40 to provide water, air, or oil to the bellows 16.

It is contemplated that any number of bellows 16 could be utilized. The bellows 16 may be of any type known in the art. FIGS. 1, 2, and 3 show embodiments of a nozzle assembly 10,110,210 utilizing two bellows 16. FIGS. 4 through 7 show an embodiment of a nozzle assembly 310 utilizing four bellows 16. However, it should be recognized that any number of bellows 16 may be utilized.

Figure 8:
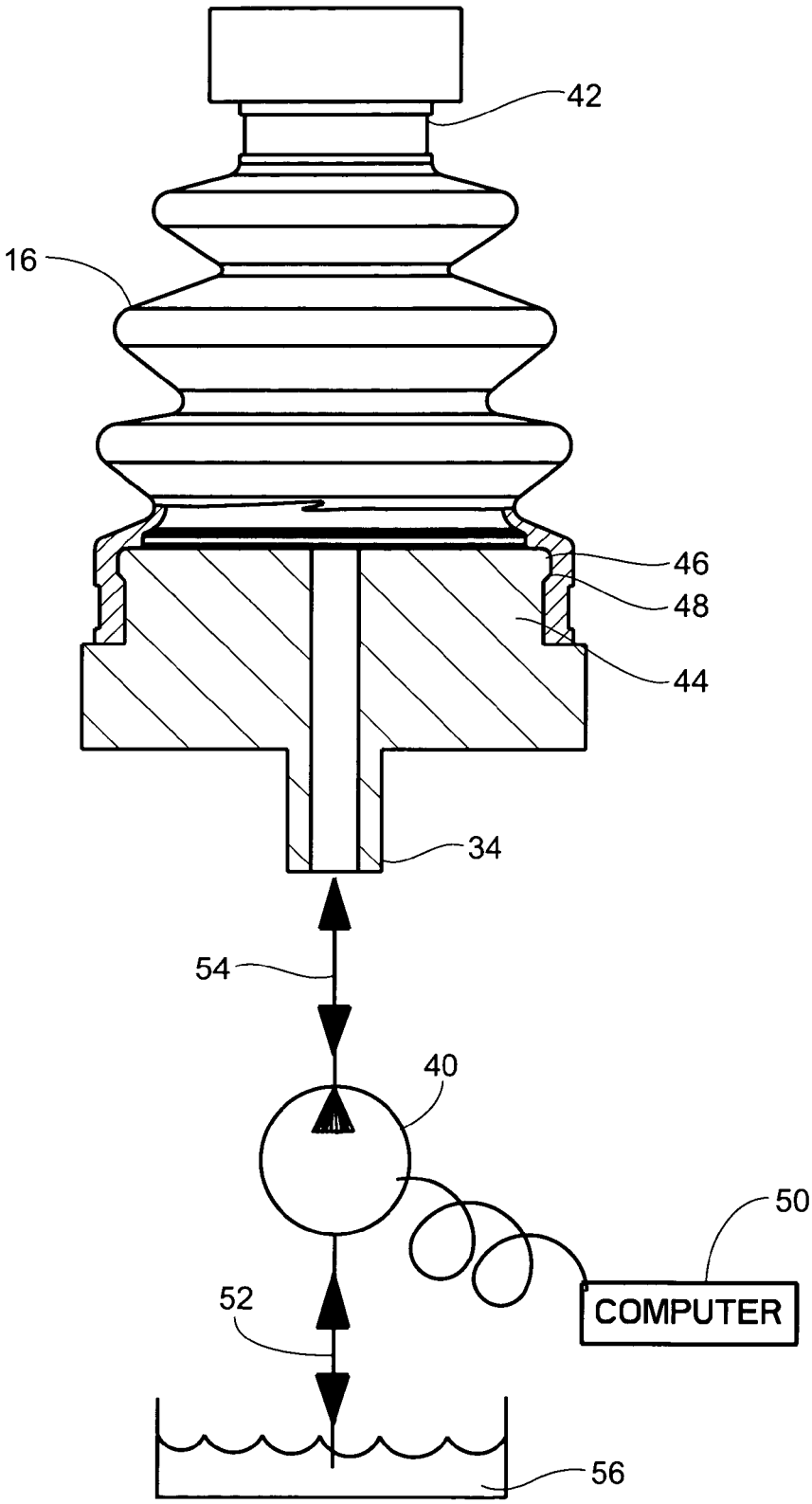
FIG. 8 is a partial cross sectional view of an embodiment of a bellows for use in the present invention.

The bellows 16 are preferably coupled to both the nozzle portion 12 and the base portion 14. In this manner, expansion or contraction of the bellows 16 changes the position of the nozzle portion 12. The bellows 16 may be coupled to the nozzle portion 12 and the base portion 14 using any means known in the art. As shown in FIG. 8, it is contemplated that a first projection 42 may be formed on the nozzle portion 12 and a second projection 44 may be formed on the base portion 14. The elastic bellows 16 may then fit over the projections 42,44. It is further contemplated that the projections 42,44 could include a lip 46 that would fit into a recess 48 in the bellows 16 to retain the bellows on the projection 46.

The bellows 16 may be activated by any means known in the art including, but not limited to any fluid such as air, water, or oil. FIGS. 1 to 3 show hydraulically charged bellows 16 activated by dedicated externally mounted pilot pumps 40 arranged for bidirectional flow through the pilot pumps 40.

Figure 9:
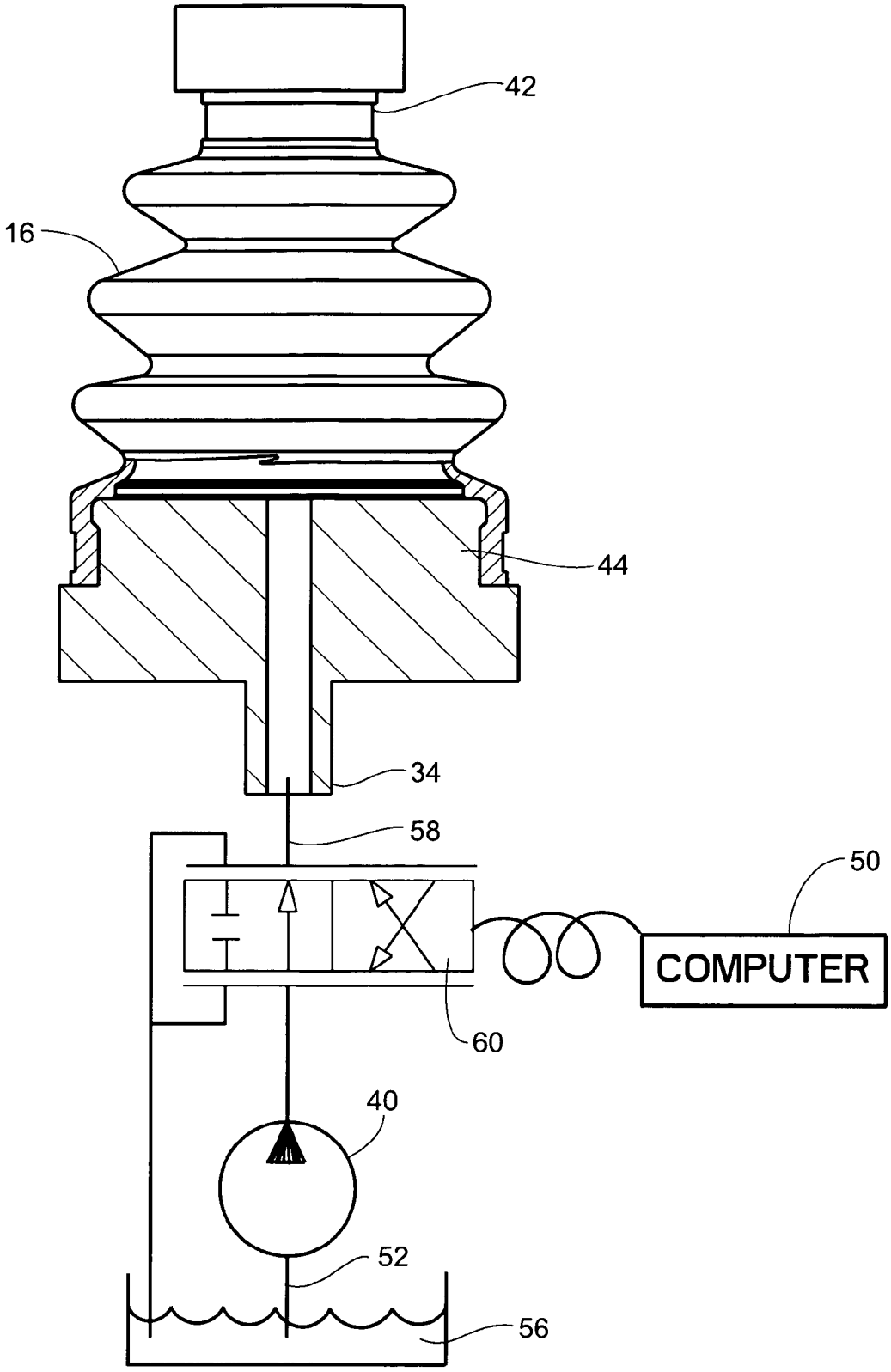
FIG. 9 is a partial cross sectional view of an alternative embodiment of a bellows for use in the present invention.
Figure 10:
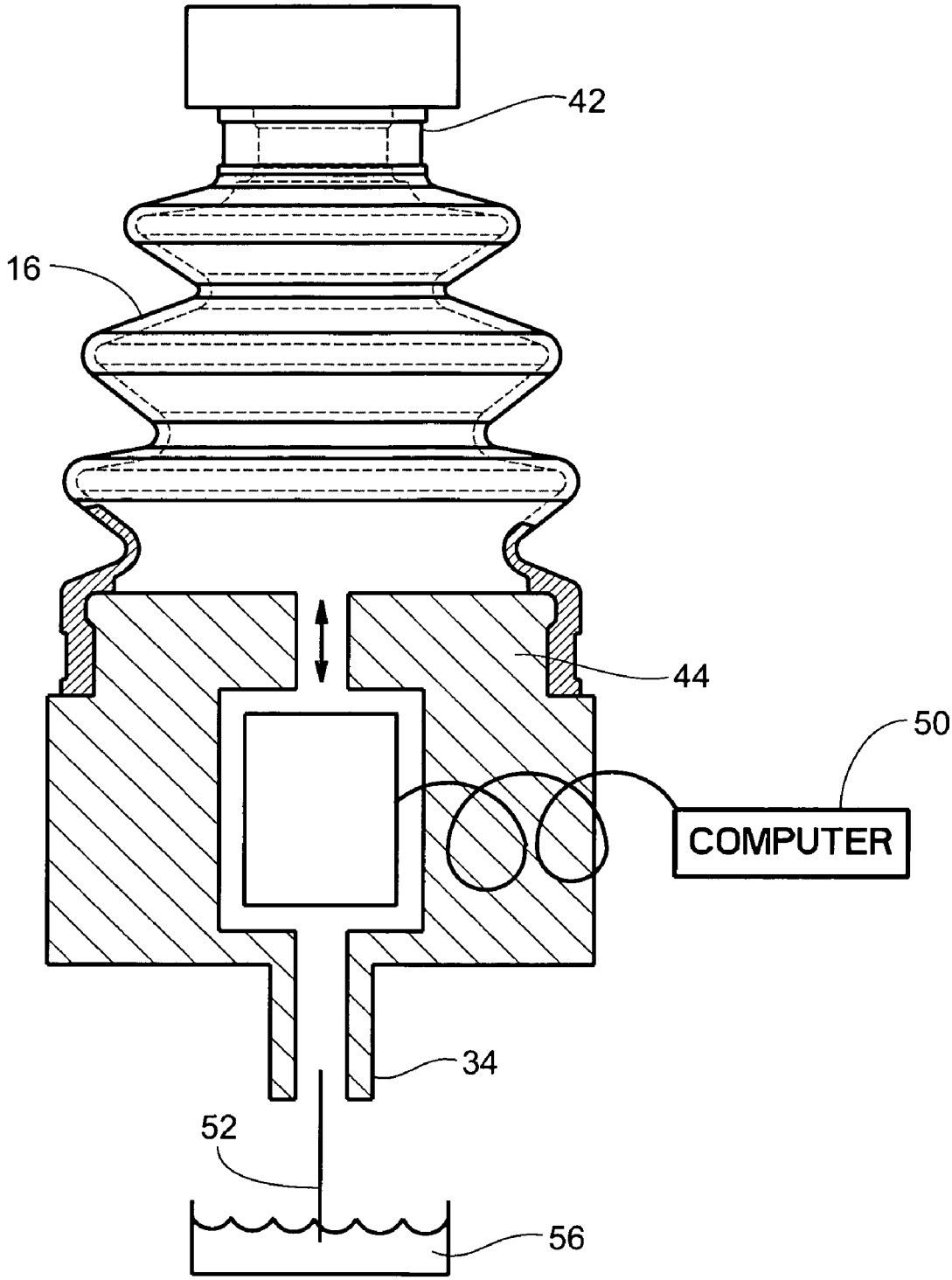
FIG. 10 is a partial cross sectional view of an alternative embodiment of a bellows for use in the present invention.

FIGS. 8 to 10 show various alternative arrangements of hydraulically charged bellows 16 which may be utilized with a nozzle assembly according to the present invention.

The embodiment illustrated in FIG. 8 utilizes an externally mounted pilot pump arranged for bidirectional flow through a computer 50 controlled pilot pump 40. Preferably, a first fluid line 52 connected the fluid source 56 to the pump 40 and a second fluid line 54 connects the pump 40 to the bellows inlet 34.

The embodiment illustrated in FIG. 9 utilizes a dedicated externally mounted pilot pump 40 arranged such that the flow to the bellows 16 is through a computer 50 controlled directional valve 60. Preferably, a first fluid line 52 connected the fluid source 56 to the pump 40 and a second fluid line 54 connects the pump 40 to the computer controlled valve 60, and a third fluid line 58 connects the computerized valve 60 to the bellows inlet 34.

The embodiment illustrated in FIG. 10 utilizes an integral pilot pump 140 built into the bellows retaining portion 32 of the base portion 14. The integrated pilot pump 140 is preferably controlled by a computer 50 and is arranged for bidirectional flow. Preferably, a first fluid line 52 connected the fluid source 56 to the bellows inlet 34.

Figure 11:
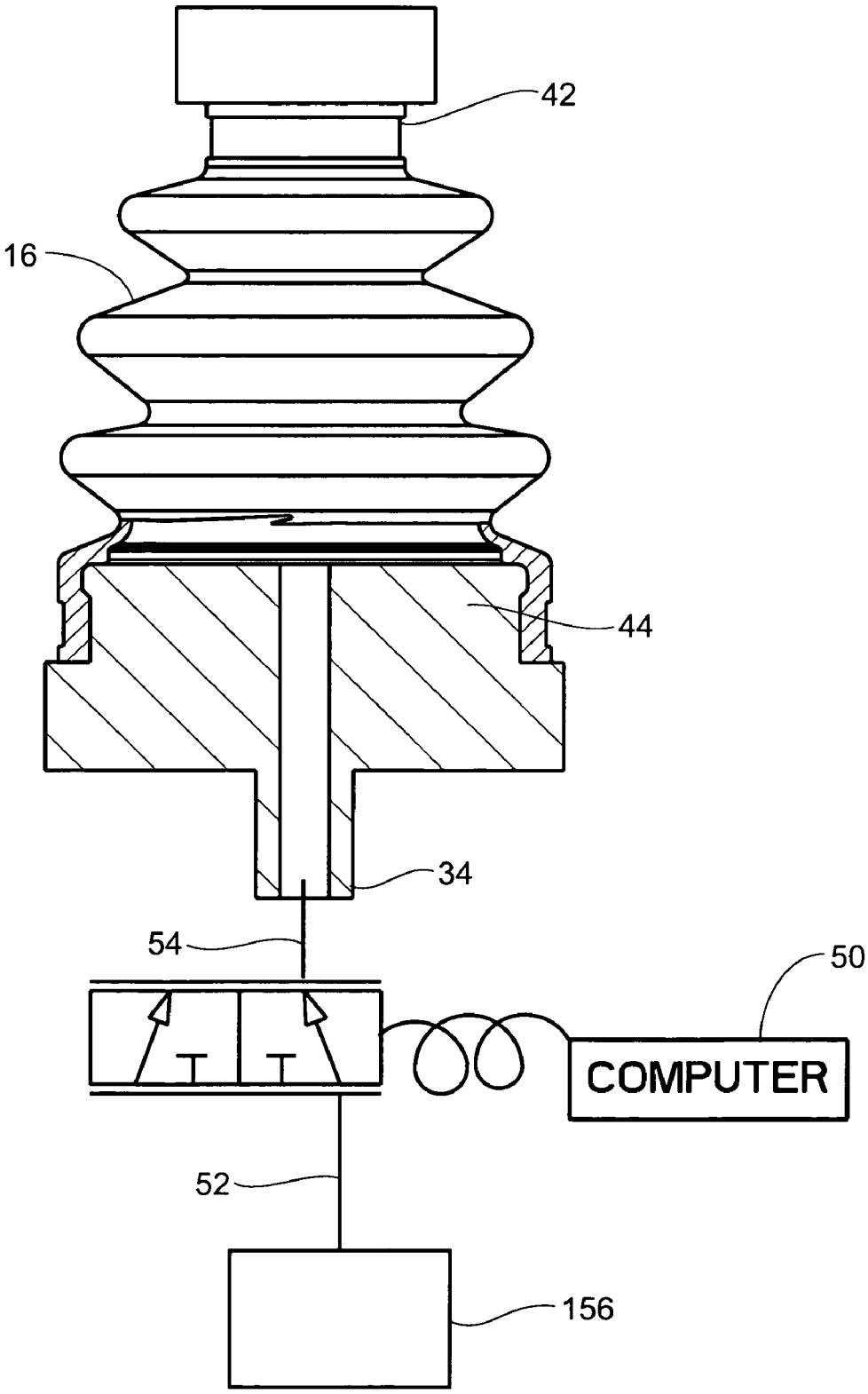
FIG. 11 is a partial cross sectional view of an alternative embodiment of a bellows for use in the present invention.

FIG. 11 shows a pneumatically charged bellows 16 with an externally mounted computer 50 controlled directional valve 60. Such a bellows 16 may be utilized in a nozzle assembly 10,110,210,310 of the types shown in FIGS. 1 to 4. It is contemplated that a first fluid line 52 could extend from an air source 156 to the valve 60 and a second fluid line 54 may extend from the valve 60 to the bellows inlet 34. It is contemplated that the computer 50 may be built into the valve 60 or that the computer 50 and valve 60 may be formed separately and be in electronic communication with each other. It is further contemplated that both the computer 50 and the valve 60 could be built into the bellows retaining portion 32 of the base portion 14.

It is contemplated that the nozzle assembly 10,110,210, 310 may be coupled to a pump 62 and a fluid source 64 to distribute a fluid through the nozzle 20. In use the fluid enters the nozzle apparatus 10,110,210,310 at the inlet 28 located in the base portion 14 and exits through an outlet 26 formed in the nozzle portion 12. While the illustrated embodiment discloses the use of water, it is contemplated that the nozzle assembly 10,110,210,310 may be utilized with any fluid, including air.

It is contemplated that the bellows 16 may be arranged in various manners. In the embodiment illustrated in FIG. 1, the bellows 16 are generally parallel to the nozzle 20. In the embodiment illustrated in FIG. 2, the bellows 16 are disposed at an angle with respect to the nozzle 20. In the embodiment illustrated in FIG. 3, the bellows 16 are generally perpendicular to the nozzle 20.

The position of the nozzle 20, and thus the direction of the fluid exiting the nozzle 20 may be changed by altering the length of the bellows 16. Each bellows 16 has a pressure inlet 34 which may be used to actuate the bellows 16. The bellows 16 may be actuated by any typical means such as air, water, or oil.

It is contemplated that the nozzle assembly 10,110,210,310 may draw fluid from the same source for both actuation of the bellows and for spraying through the nozzle, as shown in FIGS. 1 to 3. It is also contemplated that the fluid for actuation of the bellows may come from a different source and/or be of a different type than is sprayed through the nozzle 20.

For example, when fluid is added to a first bellows 16 to actuate that bellows 16, the flexible coupling 18 allows the nozzle portion 12 to tilt towards the oppositely disposed bellows 16, and fluid is pushed out that bellows 16. Actuating various bellows 16 in various orders causes the direction of the water to change. For example, actuating each bellows 16 in succession can cause the water spray to create a circle.

It is contemplated that the actuation of the bellows 16 may be controlled by a microprocessor or computer 50. In the manner, the motion of the nozzle portion 12 may be preprogrammed.

In the illustrated embodiment disclose at least one pressure inlet(s) 34 being formed in the base portion 14 of the nozzle assembly 10 to provide fluid to at least one bellows 16. However it is contemplated that at least one pressure inlet could be formed in the nozzle portion 12 to provide fluid to at least one bellows 16. It is further contemplated that at least one pressure inlet 34 coupled be formed directly in a bellows 16.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A nozzle system comprising:

a base portion, the base portion having a fluid inlet, a fluid outlet in fluid communication with the fluid inlet;

a nozzle portion flexibly coupled to the base portion with a flexible coupling, the nozzle portion having a hollow nozzle, the nozzle having a fluid inlet and a fluid outlet in fluid communication with the fluid inlet, the nozzle fluid inlet being in fluid communication with the fluid outlet;

at least one elastic bellows being disposed between the base portion and the nozzle portion, each elastic bellows having at least one pressure inlet, said at least one elastic bellows is disposed adjacent an outer perimeter of said flexible coupling; and a control device for controlling the flow of a pressurized fluid into said at least one elastic bellows, whereby filling said at least one elastic bellows with pressurized fluid causes the nozzle to tilt relative to the base portion.

2. The nozzle system of claim 1 wherein the at east one pressure inlet is an aperture through the bellows retaining portion.

3. The nozzle system of claim 1 further comprising:

a flexible coupling, wherein the base portion is coupled to the nozzle portion through the flexible coupling.

4. The nozzle system of claim 1 wherein the base portion is integrally formed to nozzle portion.

5. The nozzle system of claim 1 further comprising means for coupling the at least one bellows to the nozzle bellows retaining portion and the base bellows retaining portion.

6. The nozzle system of claim 5 wherein the means for coupling further comprises at least one projection formed on the nozzle bellows retaining portion, the at least one projection sized and configured to fit within an opening on the top of the bellows.

7. The nozzle system of claim 5 wherein the means for coupling further comprises at least one projection formed on the base bellows retaining portion, the at least on projection sized and configured to fit within an opening on the bottom of the bellows.

8. The nozzle system of claim 1 further comprising a pump, the pump having an inlet coupled to a fluid source and an outlet coupled to the base portion fluid inlet.

9. The nozzle system of claim 1 wherein the first and second pressure inlets are coupled, directly or indirectly, to a bellows activation means.

10. The nozzle system of claim 9 wherein the bellows activation means is a pump having an inlet coupled, either directly or indirectly, to a fluid source and an outlet coupled, either directly or indirectly, to the first and second pressure inlets.

11. A method comprising:

providing a first fluid source;

providing a nozzle system, the nozzle system including a base portion, the base portion having a fluid inlet, a fluid outlet in fluid communication with the fluid inlet;

a nozzle portion flexibly coupled to the base portion with a flexible coupling, the nozzle portion having a hollow nozzle, the nozzle having a fluid inlet and a fluid outlet in fluid communication with the fluid inlet, the nozzle fluid inlet being in fluid communication with the base portion fluid outlet;

a plurality of elastic bellows disposed between the base portion and the nozzle portion, each of said elastic bellows having at least one fluid port, each bellows fluid port being in fluid communication with a pressure inlet, said plurality of elastic bellows are disposed adjacent an outer perimeter of said flexible coupling; and providing a control device for controlling the flow of a pressurized fluid into said plurality of elastic bellows, whereby filling at least one of said plurality elastic bellows with more pressurized fluid than the others causes the nozzle to tilt relative to the base portion.

12. The method of claim 11 wherein said operating step further comprises filling at least a portion of at least one of the bellows with fluid.

13. The method of claim 12 further comprising providing fluid to the nozzle.

14. The method of claim 13 wherein the providing fluid step further comprises:

providing a second pump, the second pump having an inlet coupled to the first fluid source and an outlet coupled to the base portion fluid inlet; and operating the second pump to provide fluid to the nozzle through the base portion fluid inlet.

15. The method of claim 13 wherein the providing fluid step further comprises:

providing a second fluid source;

providing a second pump, the second pump having an inlet coupled to the second fluid-source and an outlet coupled to the base portion fluid inlet; and operating the second pump to provide fluid to the nozzle through the base portion fluid inlet.

16. A nozzle system comprising:

a base portion, the base portion having a fluid inlet, a fluid outlet in fluid communication with the fluid inlet;

a nozzle portion flexibly coupled to the base portion with a flexible coupling, the nozzle portion having a hollow nozzle, the nozzle having a fluid inlet and a fluid outlet in fluid communication with the fluid inlet, the nozzle fluid inlet being in fluid communication with the fluid outlet; and a first and second elastic bellows, each of the first and second elastic bellows having at least one fluid port, each elastic bellows disposed between the base portion and the nozzle portion, said first and second elastic bellows are disposed adjacent an outer perimeter of said flexible coupling;

a first and second pressure inlet extending through the base portion, the first pressure inlet in fluid communication with the first elastic bellows fluid portion and the second pressure inlet in fluid communication with the second elastic bellows fluid port; and a control device for controlling the flow of a pressurized fluid into said first and second elastic bellows, whereby filling one of said first and second elastic bellows with more pressurized fluid than another causes the nozzle to tilt relative to the base portion.

* * * * *